US009670651B1

(12) United States Patent
Wu

(10) Patent No.: US 9,670,651 B1
(45) Date of Patent: Jun. 6, 2017

(54) ANTI-FREEZE FAUCET

(71) Applicant: Cheng-Hsuan Wu, Lugang Township, Changhua County (TW)

(72) Inventor: Cheng-Hsuan Wu, Lugang Township, Changhua County (TW)

( * ) Notice: Subject to any disclaimer, the term of this patent is extended or adjusted under 35 U.S.C. 154(b) by 44 days.

(21) Appl. No.: 14/957,822

(22) Filed: Dec. 3, 2015

(51) Int. Cl.

| | |
|---|---|
| ***E03B 9/02*** | (2006.01) |
| ***E03B 7/12*** | (2006.01) |
| ***E03C 1/04*** | (2006.01) |
| *E03C 1/02* | (2006.01) |

(52) U.S. Cl.
CPC ..... *E03B 7/12* (2013.01); *E03C 1/0403* (2013.01); *E03C 2001/026* (2013.01)

(58) Field of Classification Search
CPC . E03B 7/12; E03B 9/025; F16K 31/50; Y10T 137/698
USPC ..... 137/59, 218, 301, 302, 303, 360
See application file for complete search history.

(56) References Cited

U.S. PATENT DOCUMENTS 4,212,319 A * 7/1980 Krablin ..... E03B 9/025 137/516.15
5,158,105 A * 10/1992 Conway ..... E03B 7/10 137/296
5,392,805 A * 2/1995 Chrysler ..... E03B 9/025 137/218
5,740,831 A * 4/1998 DeNardo ..... E03B 7/10 137/218
6,769,446 B1 * 8/2004 Ball ..... E03B 7/10 137/301
7,896,024 B2 * 3/2011 Korb ..... E03B 9/025 137/218
9,249,561 B2 * 2/2016 Wu ..... E03B 9/027
2013/0312845 A1 * 11/2013 Wu ..... E03B 9/027 137/218
2015/0330063 A1 * 11/2015 Wu ..... E03B 9/027 137/218

* cited by examiner

*Primary Examiner* — Reinaldo Sanchez-Medina
(74) *Attorney, Agent, or Firm* — Alan D. Kamrath; Kamrath IP Lawfirm, P.A.

(57) ABSTRACT

An anti-freeze faucet contains: a first pipe, a second pipe, a control holder, a closing member, a closing member, a controlling valve, and a resilient element. The first pipe includes a first through hole, an outlet, an inlet, a channel, and a fitting sleeve having a second through hole and an inner screwing section. The second pipe includes a vertical moving portion, a connecting portion, and an air conduit. The vertical moving portion is connected with a rotary knob and has an outer screwing section and an air orifice. The control holder includes a water aperture, a water stop ring, plural first vents, plural second vents, and a connection portion. The closing member is fitted between the control holder and the connecting portion. The controlling valve is connected with the coupling portion, and the resilient element is mounted on the coupling portion and pushes the controlling valve toward the inlet.

9 Claims, 10 Drawing Sheets

ANTI-FREEZE FAUCET

BACKGROUND OF THE INVENTION

Field of the Invention

The present invention relates to an anti-freeze faucet which flows water smoothly and greatly.

Description of the Prior Art

A conventional anti-freeze faucet prevents remained water from freezing therein, and it has a check structure configured to avoid polluted water flowing back to a water supply pipe from the anti-freeze faucet in a vacuum siphon action. The conventional anti-freeze faucet also has an air guiding device to break vacuum effect and to prevent the remained water accumulating in the anti-freeze faucet, when the anti-freeze faucet freezes.

With reference to FIGS. 8 to 10, the conventional anti-freeze faucet contains a first pipe 91, and the first pipe 91 has an inlet 911 defined on a first end thereof so as to communicate with a water supply pipe, an outlet 912 formed on a second end thereof, an opening 913, an air valve 914, and a channel 915 communicating with the inlet 911, the outlet 912, the opening 913 and the air valve 914. The channel 915 has inner threads 916 adjacent to the inlet 911. The conventional anti-freeze faucet also contains a second pipe 92 inserted into the first pipe 91, and the second pipe 92 has a connecting segment 921 and a fitting segment 922 opposite to the connecting segment 921, wherein the connecting segment 921 extends out of the first pipe 91, the fitting segment 922 has a circular tab 923 arranged around an outer rim thereof, and the circular tab 923 has outer threads 924 for screwing with the inner threads 916 and has plural slots 925 defined thereon. The conventional anti-freeze faucet further contains: a controlling valve 93 movably fitted with the fitting segment 922 of the second pipe 92 so as to close the inlet 911 of the first pipe 91; a resilient element 94 fixed in the second pipe 92 proximate to the fitting segment 922; a single-directional seal washer 95 fitted with the second pipe 92 adjacent to the fitting segment 922 so as to limit water to flow in the channel 915 in a single direction; and a control assembly 96 connected with the opening 913 of the first pipe 91 and the second pipe 92 so as to rotate the second pipe 92 to move, thus turning on/off the anti-freeze faucet.

However, the conventional anti-freeze faucet stops the waters flowing in the water supply pipe, and because vacuum siphon action produces a reverse suction, the single-directional seal washer 95 stops the water reversely flowing into the water supply pipe from an water outflow connector of the first pipe 91, and the resilient element 40 pushes the controlling valve 30 toward the inlet 11 of the first pipe 10 so that a stopping washer 312 of a plug 31 of the controlling valve 30 automatically closes the outlet 11 of the first pipe 10, thus preventing the polluted water from flowing back to the water supply pipe from the anti-freeze faucet. The second pipe 92 screws with the inner threads 916 of the inlet 911 of the first pipe 91 by using the outer threads 924 of the circular tab 923 of the fitting segment 922, hence as turning on the conventional anti-freeze faucet, the water pushes the controlling valve 93 via the inlet 911 of the first pipe 91, and the controlling valve 93 removes from the outlet 911 of the first pipe 91 so that the water flows out of the outlet 912 of the first pipe 91 from the inlet 911 of the first pipe 91 through the channel 915 of the first pipe 91 and the plural slots 925 of the second pipe 92 and the single-directional seal washer 95. Nevertheless, the water cannot flow smoothly and greatly because of the plural slots 925 of the second pipe 92.

The present invention has arisen to mitigate and/or obviate the afore-described disadvantages.

SUMMARY OF THE INVENTION

The primary objective of the present invention is to provide an anti-freeze faucet in which an outer screwing section of a vertical moving portion of a second pipe screws with an inner screwing section of a fitting sleeve of a first pipe, and a rotary knob is rotated to drive the second pipe to move, thus turning on/off the anti-freeze faucet. Preferably, the second pipe moves to a through hole of the first pipe so as to reduce a using space between the second pipe and the first pipe, thus flowing the water smoothly and greatly.

An anti-freeze faucet provided by the present invention contains: a first pipe, a second pipe, a control holder, a closing member, a closing member, a controlling valve, and a resilient element.

The first pipe includes a first through hole defined on a first end thereof, an outlet formed on a peripheral side thereof, an inlet arranged on a second end thereof, and a channel defined therein and communicating with the first through hole, the outlet, and the inlet. The first pipe further includes a fitting sleeve connected with the through hole, the fitting sleeve has a second through hole formed on a central portion thereof and has an inner screwing section arranged therein.

The second pipe is inserted into the first pipe, and the second pipe includes a vertical moving portion mounted on a first end thereof, a connecting portion fixed on a second end thereof, and an air conduit defined therein. The vertical moving portion is connected with a rotary knob and has an outer screwing section and an air orifice, the outer screwing section screws with the inner screwing section of the fitting sleeve of the first pipe, wherein the rotary knob is rotated to drive the second pope to move vertically, and the air orifice is in communication with the air conduit.

The control holder includes a first end coupling with the connecting portion of the second pipe, a water aperture defined on a central position thereof and communicating with the air conduit of the second pipe, a water stop ring fitted on a middle section of a peripheral side thereof, plural first vents defined above the water stop ring and communicating with the water aperture, plural second vents formed below the water stop ring and communicating with the water aperture, and a connection portion secured on a second end thereof.

The closing member is movably fitted between the control holder and the connecting portion of the second pipe so as to movably open or close the air conduit of the second pipe and the water aperture of the control holder.

The controlling valve is in connection with the coupling portion of the control holder to close the inlet of the first pipe.

The resilient element is mounted on the coupling portion of the control holder and pushes the controlling valve toward the inlet of the first pipe.

DETAILED DESCRIPTION OF THE PREFERRED EMBODIMENTS

Figure 1:
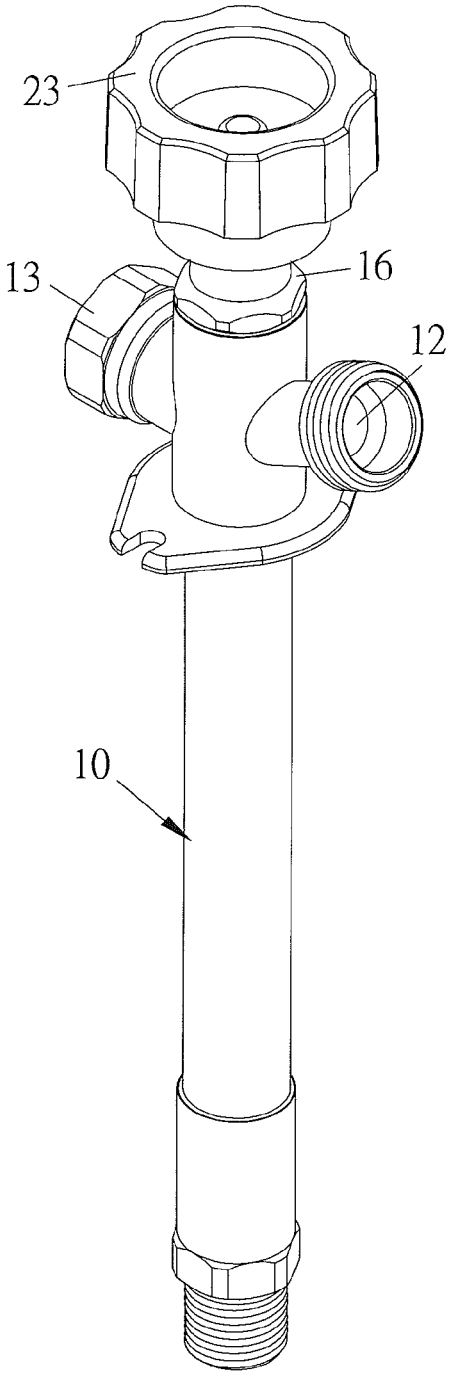
FIG. 1 is a perspective view showing the assembly of an anti-freeze faucet in accordance with a preferred embodiment of the present invention.
Figure 2:
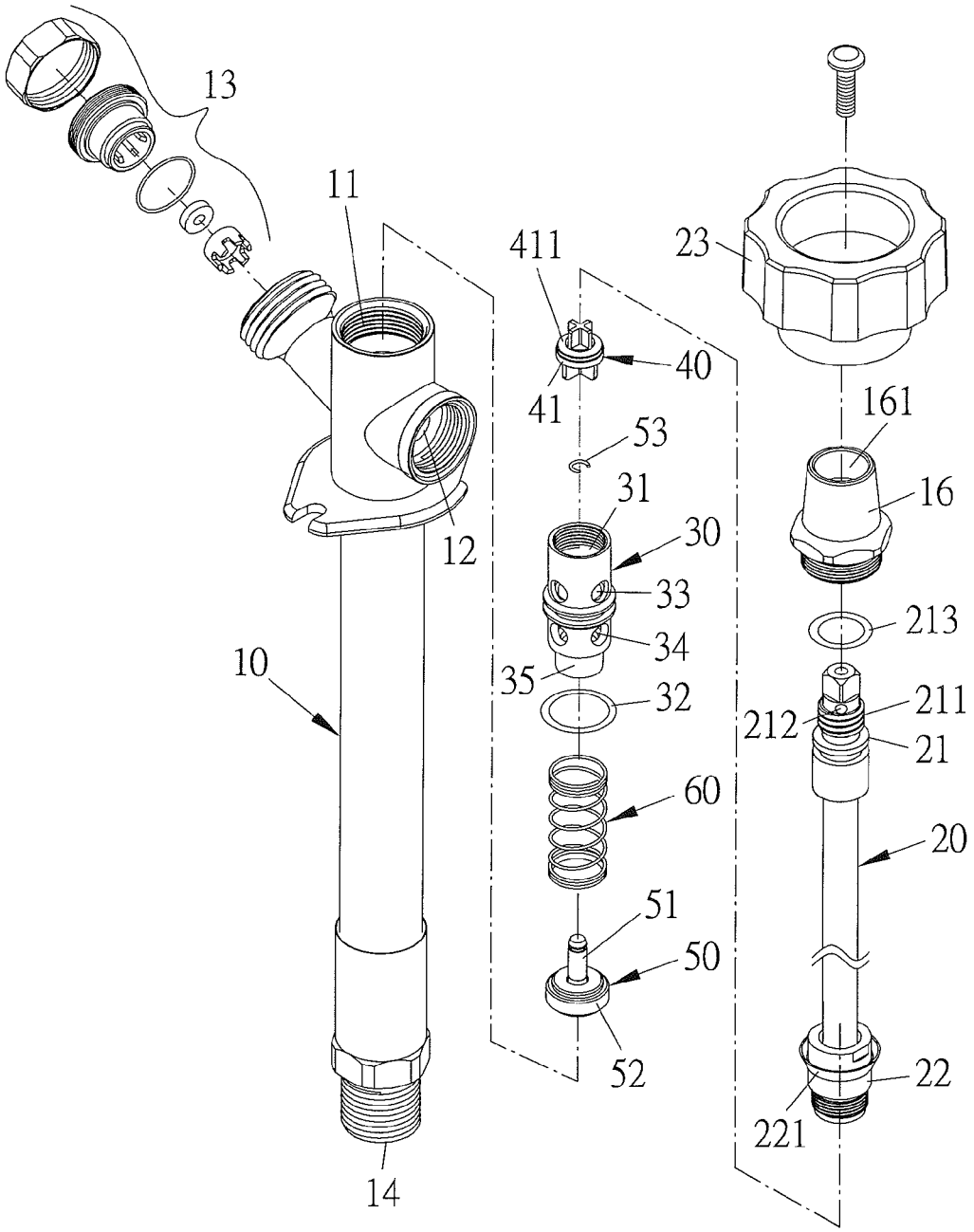
FIG. 2 is a perspective view showing the exploded components of the anti-freeze faucet in accordance with the preferred embodiment of the present invention.

The present invention will be clearer from the following description when viewed together with the accompanying drawings, which show, for purpose of illustrations only, the preferred embodiment in accordance with the present invention.

Referring to FIGS. 1-5, an anti-freeze faucet according to a preferred embodiment of the present invention comprises: a first pipe 10, a second pipe 20, a control holder 30, a closing member 40, a controlling valve 50, and a resilient element 60.

The first pipe 10 includes a first through hole 11 defined on a first end thereof, an outlet 12 formed on a peripheral side thereof, an air valve 13 disposed on the peripheral side thereof relative to the outlet 12, an inlet 14 arranged on a second end thereof and communicating with a water supply pipe, and a channel 15 defined therein and communicating with the first through hole 11, the outlet 12, the air valve 13 and the inlet 14; the first pipe 10 further includes a fitting sleeve 16 connected with the through hole 11, wherein the fitting sleeve 16 has a second through hole 161 formed on a central portion thereof and has an inner screwing section 162 arranged therein, wherein the inner screwing section 162 is multiple threads.

The second pipe 20 is inserted into the first pipe 10, and the second pipe 20 includes a vertical moving portion 21 mounted on a first end thereof, a connecting portion 22 fixed on a second end thereof, and a rotary knob 23 connected with the vertical moving portion 21. The vertical moving portion 21 has an outer screwing section 211, an air orifice 212, and a sealing ring 213, wherein the outer screwing section 211 is multiple threads and is configured to screw with the inner screwing section 162 of the fitting sleeve 16, and the rotary knob 23 drives the second pipe 20 to rotate and move vertically, the air orifice 212 is in communication with an exterior, the sealing ring 213 is fitted with the vertical moving portion 21 and is biased against the second through hole 161 of the fitting sleeve 16 of the first pipe 10. The connecting portion 22 has a single-directional seal washer 221 fitted thereon and abutting against an inner wall of the first pipe 10, such that water flows out of the outlet 12 of the first pipe 10 and does not flow reverse to the outlet 12. The second pipe 20 also includes an air conduit 24 defined therein and communicating with the air orifice 212 of the vertical moving portion 21 and the connecting portion 22.

The control holder 30 includes a first end coupling with the connecting portion 22 of the second pipe 20, a water aperture 31 defined on a central position thereof and communicating with the air conduit 24 of the second pipe 20, a water stop ring 32 fitted on a middle section of a peripheral side thereof, plural first vents 33 defined above the water stop ring 32 and communicating with the water aperture 31, plural second vents 34 formed below the water stop ring 32 and communicating with the water aperture 31, and a connection portion 35 secured on a second end thereof.

The closing member 40 is movably fitted between the control holder 30 and the connecting portion 22 of the second pipe 20, and the closing member 40 includes a circular sealing portion 41, wherein the circular sealing portion 41 has a first closing gasket 411 facing the connecting portion 22 of the second pipe 20 so as to movably open or close the air conduit 24 of the second pipe 20 and the water aperture 31 of the control holder 30.

The controlling valve 50 includes a shank 51 and a stop plug 52 connecting with the shank 51, wherein the shank 51 is inserted into the coupling portion 35 of the control holder 30 and is limited by a C-shaped retainer 53, such that the controlling valve 50 is in connection with the coupling portion 35 of the control holder 30 and moves, the stop plug 52 has a second closing gasket 521 facing and configured to close the inlet 14 of the first pipe 10.

The resilient element 60 is a spring and is mounted on the coupling portion 35 of the control holder 30, wherein the resilient element 60 pushes the controlling valve 50 toward the inlet 14 of the first pipe 10.

Figure 3:
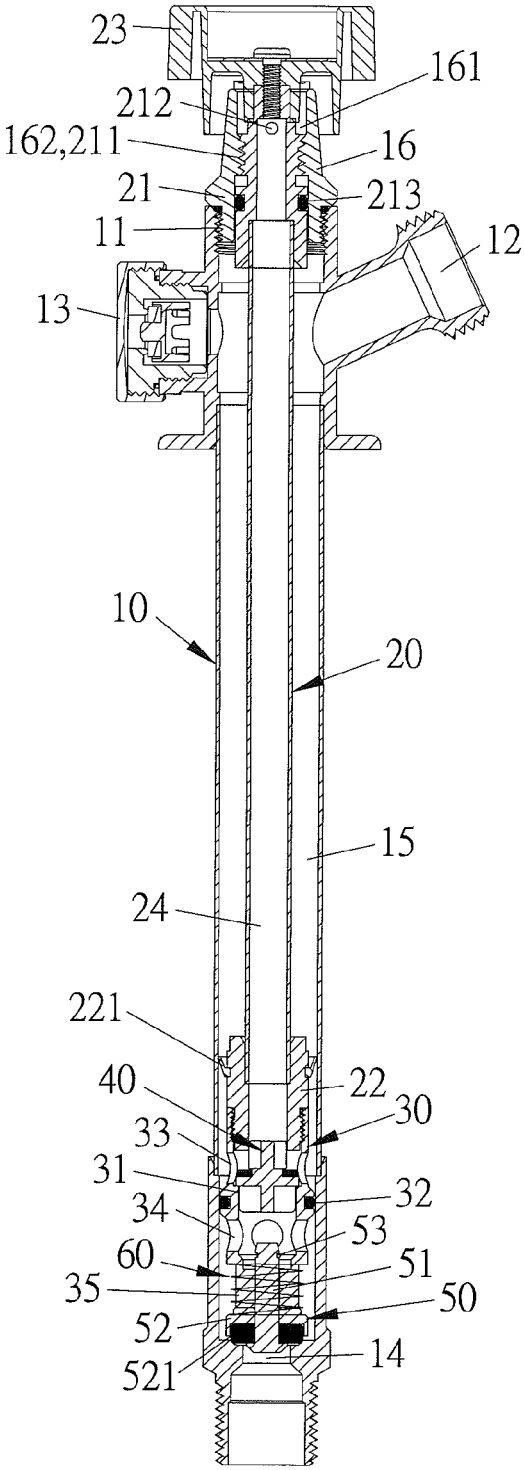
FIG. 3 is a cross sectional view showing the assembly of the anti-freeze faucet in accordance with the preferred embodiment of the present invention.

Referring to FIG. 3, as not turning on the anti-freeze faucet, the second pipe 20 presses the controlling valve 50 downwardly via the control holder 30 so that the stop plug 52 of the controlling valve 50 mates with the second closing gasket 521 to close the inlet 14 of the first pipe 10, and the resilient element 60 is pushed by the control holder 30 to move toward the controlling valve 50.

Figure 4:
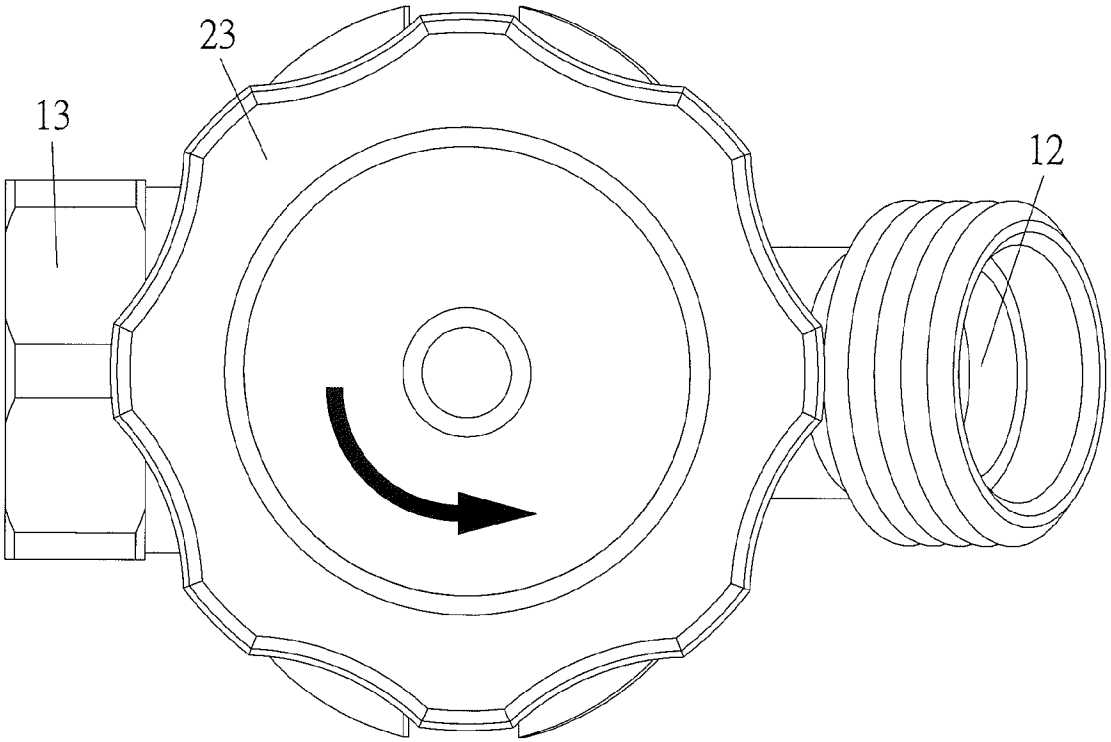
FIG. 4 is a perspective view showing the operation of the anti-freeze faucet in accordance with the preferred embodiment of the present invention.
Figure 5:
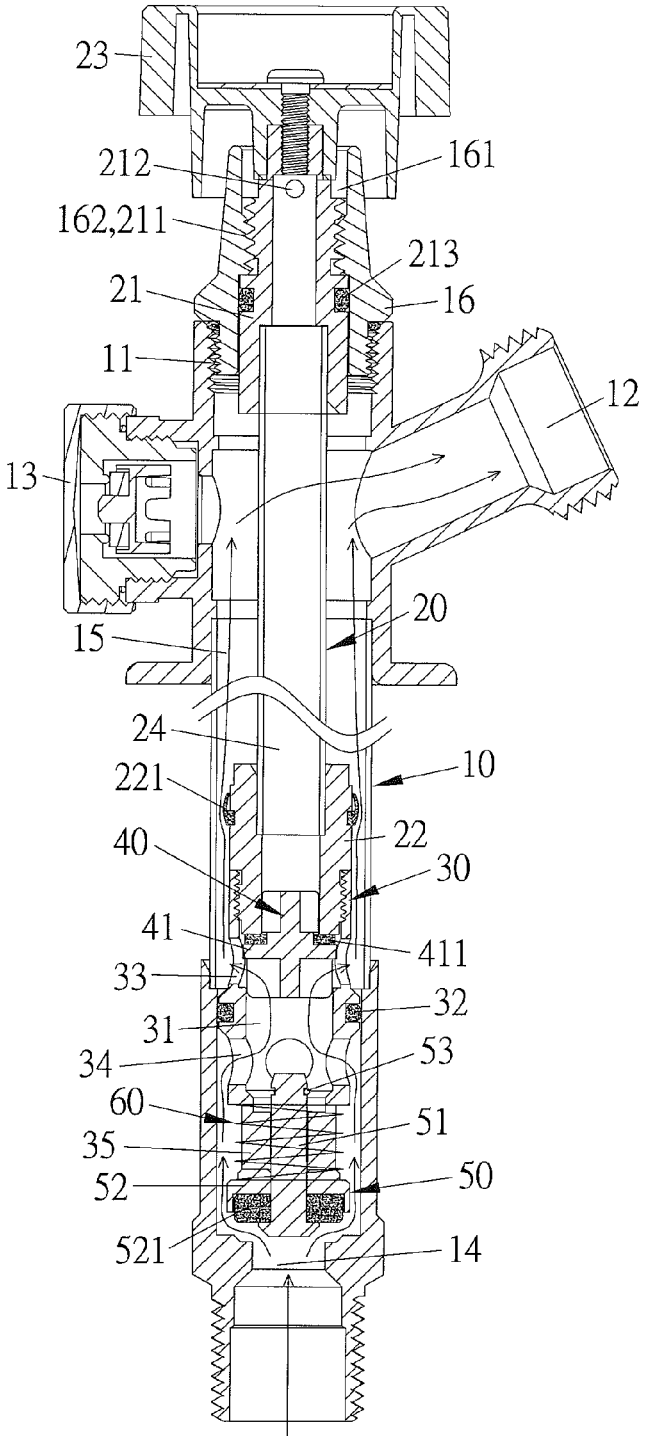
FIG. 5 is a cross sectional view showing the operation of the anti-freeze faucet in accordance with the preferred embodiment of the present invention.

As shown in FIGS. 4 and 5, as turning on the anti-freeze faucet, the rotary knob 23 is rotated to drive the second pipe 20 to revolve, the outer screwing section 211 of the second pipe 20 screws with the inner screwing section 162 of the fitting sleeve 16 of the first pipe 10 so that the second pipe 20 drives the control holder 30 to move upwardly toward the through hole 11 of the first pipe 10, and the controlling valve 50 is pushed by a water pressure to press the resilient element 60 and to turn on the inlet 14 of the first pipe 10, wherein the water flows into the channel 15 of the first pipe 10 from the inlet 14 and flows into the water aperture 31 of the control holder 30 through the plural second vents 34 of the control holder 30, hence the water pressure pushes the closing member 40 to move toward the connecting portion 22 of the second pipe 20, and the circular sealing portion 41 of the closing member 40 matches with the first closing gasket 411 to contact with the connecting portion 22 of the second pipe 20 and to close the air conduit 24 of the second pipe 20 and the water aperture 31 of the control holder 30. Thereafter, the water flows into the channel 15 of the first pipe 10 from the plural first vents 33 of the control holder 30 and flows out of the outlet 12 of the first pipe 10 via the single-directional seal washer 221.

Figure 6:
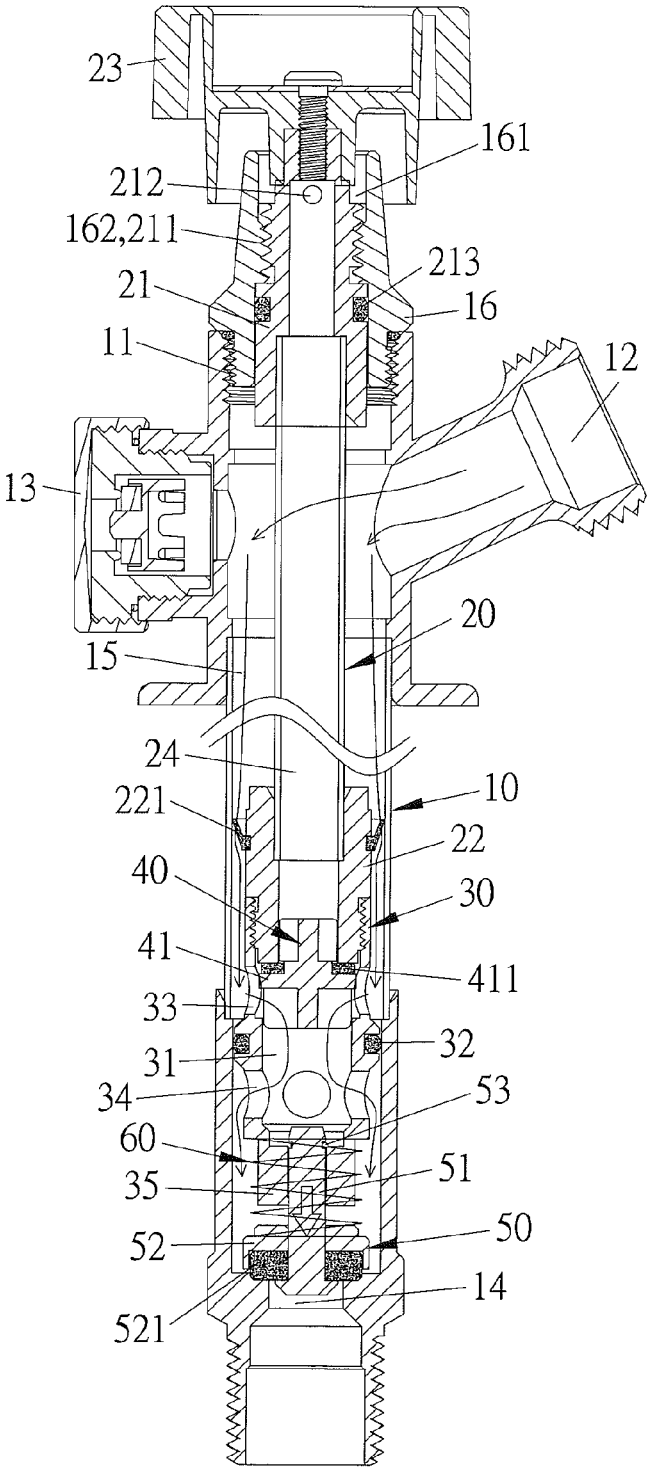
FIG. 6 is another cross sectional view showing the operation of the anti-freeze faucet in accordance with the preferred embodiment of the present invention.

After turning on the anti-freeze faucet and the water is stopped, as illustrated in FIG. 6, the water flows out of the outlet 12 from the inlet 14 through the channel 15 and the water aperture 31. When the water does not flow into the anti-freeze faucet from the inlet 14 anymore, the controlling valve 50 is not pushed by the water pressure, and the resilient element 60 abuts against the controlling valve 50 so that the stop plug 52 cooperates with the second closing gasket 521 to automatically close the inlet 14 of the first pipe 10, and the single-directional seal washer 221 stops the water flowing backward, thus avoiding polluted water flowing back to the water supply pipe from the anti-freeze faucet.

Figure 7:
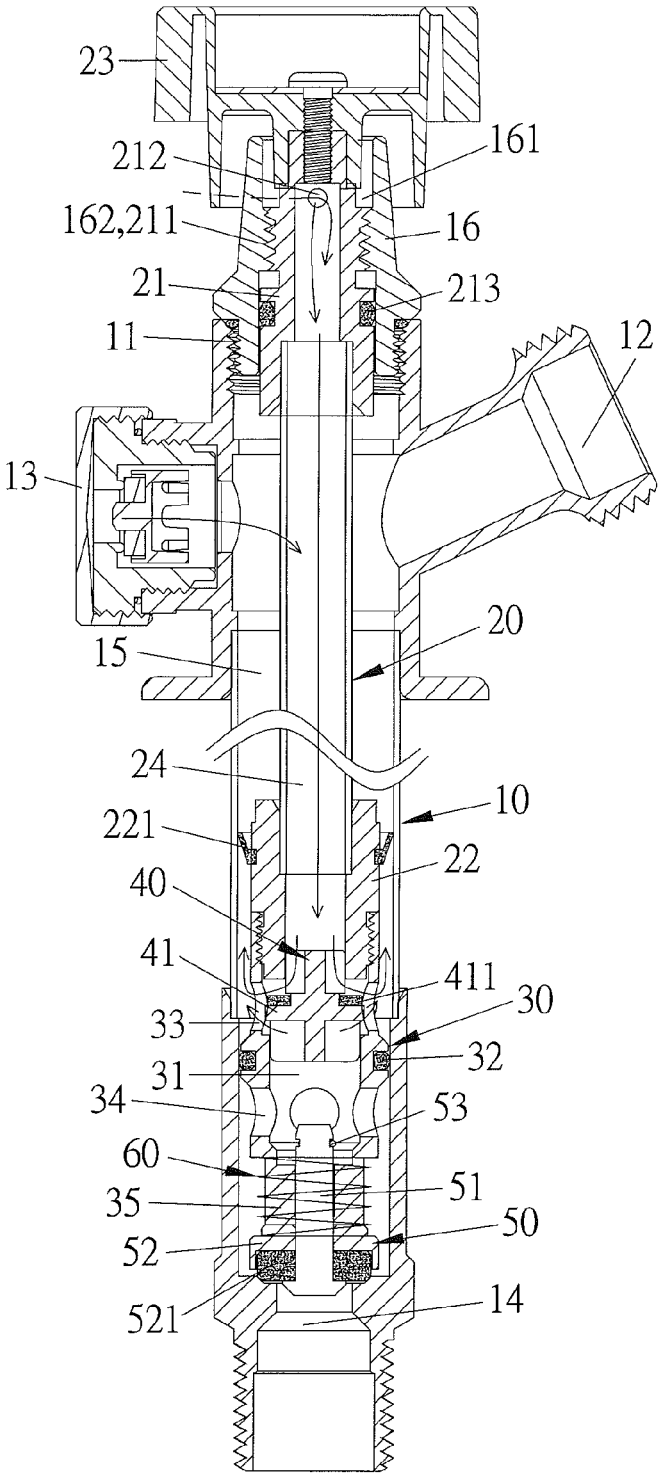
FIG. 7 is also another cross sectional view showing the operation of the anti-freeze faucet in accordance with the preferred embodiment of the present invention.
Figure 8:
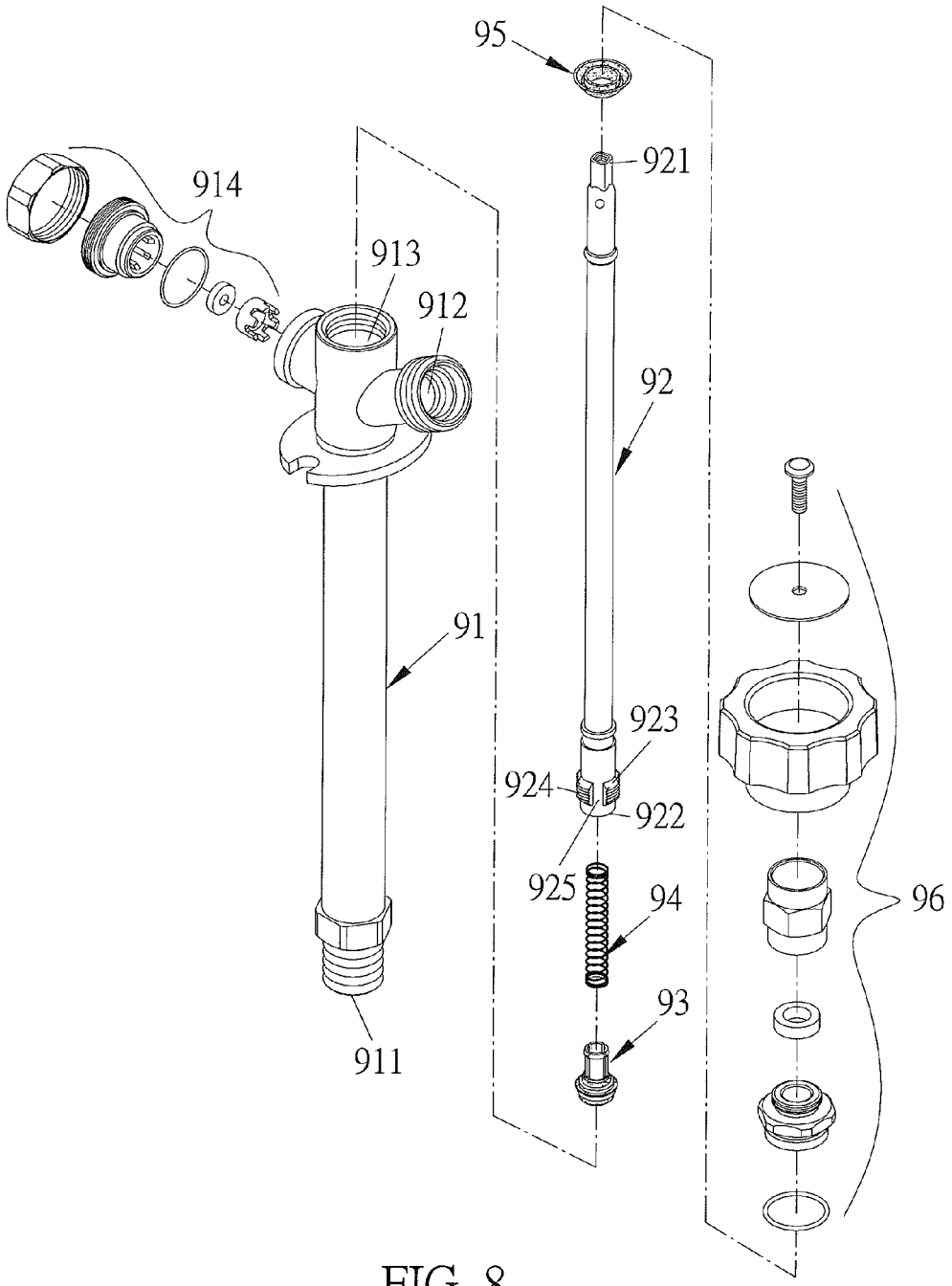
FIG. 8 Prior Art
FIG. 8 is a perspective view showing the exploded components of a conventional anti-freeze faucet.
Figure 9:
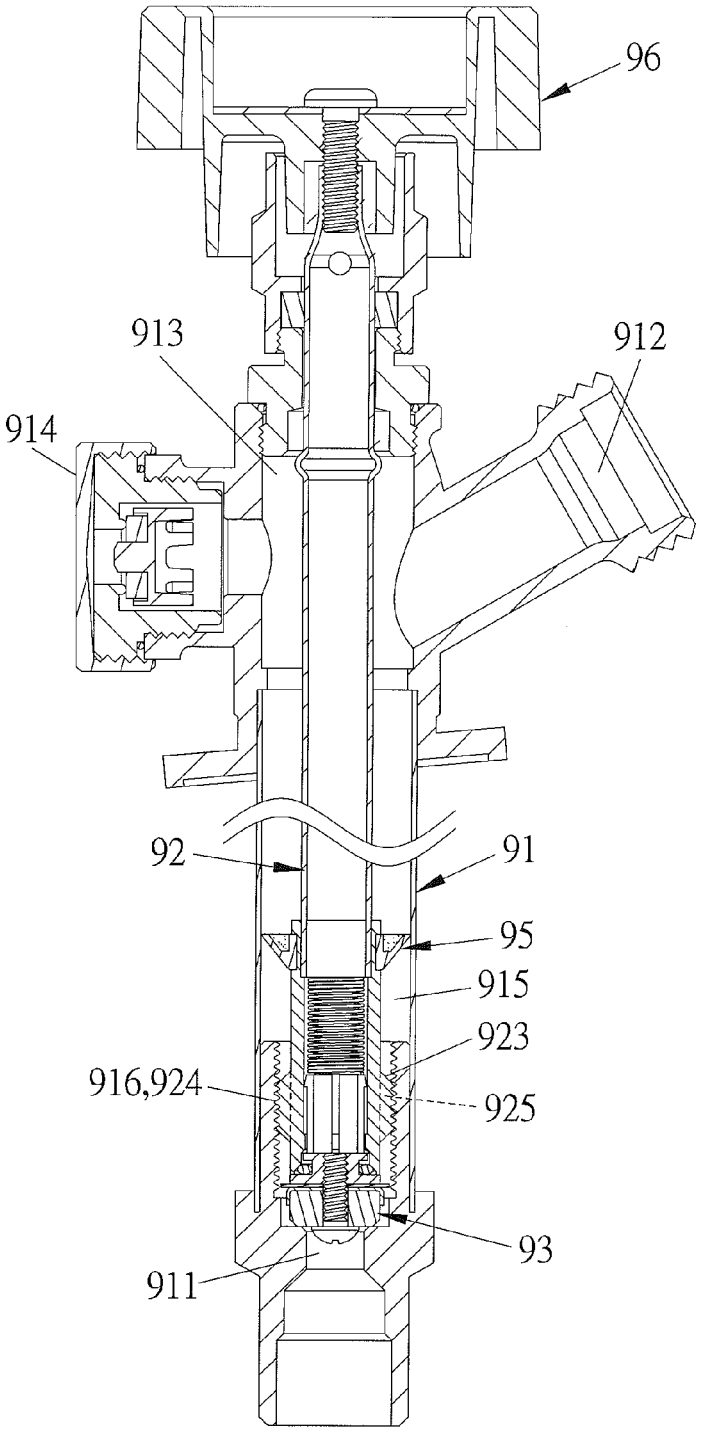
FIG. 9 Prior Art
FIG. 9 is a cross sectional view showing the assembly of the conventional anti-freeze faucet.
Figure 10:
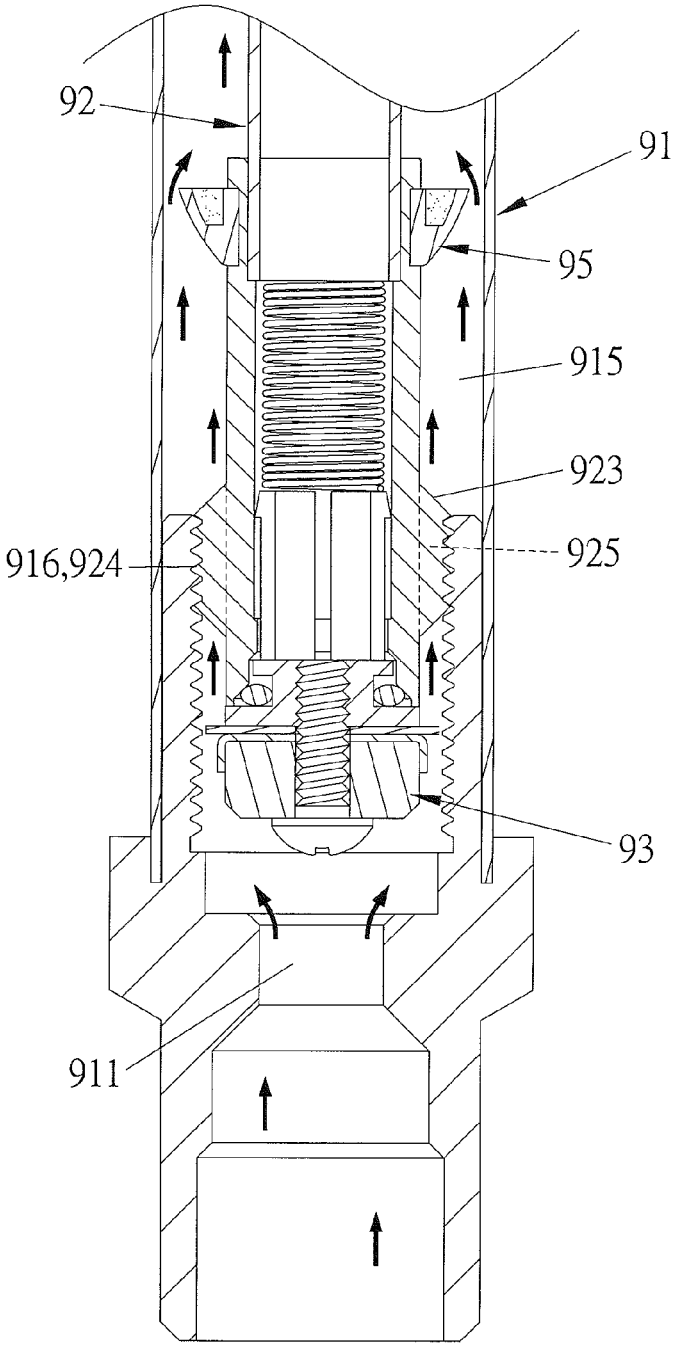
FIG. 10 Prior Art
FIG. 10 is a cross sectional view showing the operation of a part of the conventional anti-freeze faucet.

After turning off the anti-freeze faucet which supplies the water, as shown in FIG. 7, the rotary knob 23 is rotated reversely to drive the second pipe 20 to rotate by screwing the outer screwing section 211 of the second pipe 20 with the inner screwing section 162 of the fitting sleeve 16 of the first pipe 10, the second pipe 20 rotates reversely to drive the control holder 30 to move downwardly toward the outlet 12 of the first pipe 10, the second pipe 20 presses the controlling valve 50 through the control holder 30, and the stop plug 52 of the controlling valve 50 cooperates with the second closing gasket 521 to close the inlet 14 of the first pipe 10, and the water stops flowing into the inlet 14. Thereafter, the closing member 40 moves to turn on the air conduit 24 of the second pipe 20 which is in communication with the water aperture 31 of the control holder 30, hence air flows into the plural first vents 33 of the control holder 30 from the air orifice 212 of the vertical moving portion 21 via the air conduit 24, the water aperture 31, and the plural first vents 33 of the control holder 30 by using the air valve 13 of the first pipe 10, thus breaking vacuum effect. In addition, remained water in the channel 15 of the first pipe 10 and the water aperture 31 of the control holder 30 keeps flowing out of the outlet 12 via the single-directional seal washer 221.

Accordingly, the anti-freeze faucet of the present invention has advantages as follows:

the water does not accumulate in the anti-freeze facet, and the polluted water does not flow back to the water supply pipe from the anti-freeze faucet, wherein the outer screwing section 211 of the vertical moving portion 21 of the second pipe 20 screws with the inner screwing section 162 of the fitting sleeve 16 of the first pipe 10, the rotary knob 23 is rotated to drive the second pipe 20 to move, thus turning on/off the anti-freeze faucet. Preferably, the second pipe 20 moves to the through hole 11 of the first pipe 10 so as to reduce a using space between the second pipe 20 and the first pipe 10, thus flowing the water smoothly and greatly.

While we have shown and described various embodiments in accordance with the present invention, it is clear to those skilled in the art that further embodiments may be made without departing from the scope of the present invention.

What is claimed is:

1. An anti-freeze faucet comprising: a first pipe including a first through hole defined on a first end thereof, an outlet formed on a peripheral side thereof, an inlet arranged on a second end thereof, and a channel defined therein and communicating with the first through hole, the outlet, and the inlet; the first pipe further including a fitting sleeve connected with the through hole, the fitting sleeve having a second through hole formed on a central portion thereof, and the fitting sleeve also having an inner screwing section arranged therein; a second pipe inserted into the first pipe, and the second pipe including a vertical moving portion mounted on a first end thereof, a connecting portion fixed on a second end thereof, and an air conduit defined therein, the vertical moving portion being connected with a rotary knob and having an outer screwing section and an air orifice, the outer screwing section screwing with the inner screwing section of the fitting sleeve of the first pipe, wherein the rotary knob is rotated to drive the second pipe to move vertically, and the air orifice is in communication with the air conduit; a control holder including a first end coupling with the connecting portion of the second pipe, a water aperture defined on a central position thereof and communicating with the air conduit of the second pipe, a water stop ring fitted on a middle section of a peripheral side thereof, plural first vents defined above the water stop ring and communicating with the water aperture, plural second vents formed below the water stop ring and communicating with the water aperture, and a coupling portion secured on a second end thereof; a closing member movably fitted between the control holder and the connecting portion of the second pipe so as to movably open or close the air conduit of the second pipe and the water aperture of the control holder; a controlling valve being in connection with the coupling portion of the control holder to close the inlet of the first pipe; and a resilient element mounted on the coupling portion of the control holder and pushing the controlling valve toward the inlet of the first pipe.

2. The anti-freeze faucet as claimed in claim 1, wherein each of the inner screwing section of the first pipe and the outer screwing section of the second pipe is multiple threads.

3. The anti-freeze faucet as claimed in claim 1, wherein the first pipe further includes an air valve disposed on the peripheral side thereof relative to the outlet and communicating with the channel of the first pipe.

4. The anti-freeze faucet as claimed in claim 1, wherein the vertical moving portion of the second pipe has a sealing ring fitted therewith.

5. The anti-freeze faucet as claimed in claim 1, wherein the vertical moving portion of the second pipe has a sealing ring fitted therewith and biased against the second through hole of the fitting sleeve of the first pipe.

6. The anti-freeze faucet as claimed in claim 1, wherein the connecting portion of the second pipe has a single-directional seal washer fitted thereon and abutting against an inner wall of the first pipe, such that water flows out of the outlet of the first pipe and does not flow reverse to the outlet.

7. The anti-freeze faucet as claimed in claim 1, wherein the closing member includes a circular sealing portion, and the circular sealing portion has a first closing gasket facing the connecting portion of the second pipe.

8. The anti-freeze faucet as claimed in claim 1, wherein the controlling valve includes a shank and a stop plug connecting with the shank, wherein the shank is inserted into the coupling portion of the control holder and is limited by a C-shaped retainer, such that the controlling valve is in connection with the coupling portion of the control holder and moves, the stop plug has a second closing gasket facing the inlet of the first pipe.

9. The anti-freeze faucet as claimed in claim 1, wherein the resilient element is a spring.

* * * * *